US005529162A

United States Patent [19]

Zirkiev

[11] Patent Number: 5,529,162

[45] Date of Patent: Jun. 25, 1996

[54] COIN SLIDE FOR A COIN CHUTE ASSEMBLY

[75] Inventor: Arkady Zirkiev, Forest Hills, N.Y.

[73] Assignee: Greenwald Industries Inc., Brooklyn, N.Y.

[21] Appl. No.: 273,327

[22] Filed: Jul. 11, 1994

[51] Int. Cl.[6] ..... G07F 1/00

[52] U.S. Cl. ..... 194/202; 194/343

[58] Field of Search ..... 194/204, 202, 194/235, 238, 291, 342, 343, 349

[56] References Cited

U.S. PATENT DOCUMENTS

| | | | |
|---|---|---|---|
| 1,908,380 | 5/1933 | Tratsch | 194/291 |
| 1,991,250 | 2/1935 | Shinn | 194/320 |
| 2,073,151 | 3/1937 | Hansen | 194/320 X |
| 2,179,325 | 11/1939 | Dixon | 194/291 |
| 3,774,742 | 11/1973 | Magnanelli | 194/342 |

*Primary Examiner*—F. J. Bartuska

*Attorney, Agent, or Firm*—McAulay Fisher Nissen Goldberg & Kiel

[57] ABSTRACT

An improved coin slide for use in a coin chute assembly is disclosed in which the coin slide has a handle portion extending upwardly from the upper surface of the slide. The handle has an inwardly facing inclined surface which is defined in terms of a line positioned at an obtuse angle to a second line defined by the upper surface of the slide. The configuration is such that the obtuse angle defined by these two lines, and the radius of curvature at the corner between the inwardly facing sloping surface of the handle and the upper surface of the slide, are sufficiently large to cause a prybar applied to the inwardly facing surface of the handle to ride up the sloping surface without being able to exert a force sufficient to move the coin slide outwardly to its retracted position against the action of a ratchet mechanism.

8 Claims, 2 Drawing Sheets

COIN SLIDE FOR A COIN CHUTE ASSEMBLY

BACKGROUND OF THE INVENTION

1. Field of the Invention

This invention relates in general to an improved coin slide for use in a coin chute assembly and, in particular, to a coin slide which is configured to significantly reduce the likelihood of unauthorized retrieval of coins carried by the slide.

2. Description of the Prior Art

Coin chute assemblies are usually installed on commercial appliances such as clothes washers, dryers, vending machines, and the like. The assembly typically is mounted to a housing which, in turn, is mounted on the appliance or machine. The assembly includes a coin chute having a coin slide reciprocally mounted in a guide track for inserted or inward movement of the assembly and retracted or outward movement thereof. The coin slide is formed having one or more coin receiving slots whereby the presence of an appropriately sized coin in the slot is operative to allow inward movement of the coin slide to an operative position thereof. The inner end of the coin slide is provided with an operator for actuating the appliance or machine upon continued movement of the slide inwardly to its operate position.

The housing of the assembly usually is provided with a locked coin drawer which prevents unauthorized access to a coin receptacle located below and in spaced relation to the coin slide. The arrangement is such that the coins necessary to operate the appliance or machine are carried by the coin slide upon inserted movement of the slide to its operate position whereupon the coins exit from the assembly through suitable openings thereby to be transmitted to the coin receptacle.

In order to facilitate reciprocal movement of the coin slide, a finger-gripping portion is provided which extends upwardly from the horizontal upper surface of the slide. The finger-gripping portion functions as a handle which generally is located at the outer end of the coin slide. The inwardly facing surface of the handle typically is disposed in a vertical plane substantially perpendicular to the upper surface of the slide. In other instances, the inwardly facing surface of the handle is only slightly inclined upwardly from the upper surface of the slide as well as rearwardly in the direction of the outwardly facing surface of the handle.

The aforesaid configuration permitted a user of the appliance to which the coin chute was assembled to move the coin slide partially inwardly, carrying the coin or coins therewith, a distance sufficient to actuate the appliance but not yet sufficient for the coins to exit the assembly. At this point, outward movement of the coin slide to its retracted position, if permitted, would enable the user to retrieve the coins still carried by the slide, thereby permitting the user to get free use of the appliance.

To reduce such instances of free use of the appliance, it is well known to provide the coin chute assembly with a ratchet mechanism to prevent retracted movement of the coin slide after it has been inserted a predetermined distance. The ratchet mechanism permits retraction of the coin slide only after it has been moved to its fully inserted position to deposit the coins in the coin receptacle.

In order to overcome the effect of the ratchet mechanism and obtain free use of the appliance, an unscrupulous user would move the coin slide partially inwardly a distance only sufficient to actuate the appliance. At this stage, with the coins still in position to be carried by the coin slide, the user would place one end of a prybar against the inwardly facing substantially vertical surface of the slide handle. Then, using a surface of the housing to which the coin chute assembly is mounted as a bearing point, the prybar would be manipulated to exert a force on the handle sufficient to move the coin slide outwardly to its retracted position, thereby permitting retrieval of the coins and free use of the appliance. Such forced movement of the coin slide effectively destroys the ratchet mechanism, thereby permitting continued free use of the appliance. This, in turn, results in lost income to the vending appliance owner or operator, and subjects such owner/operator to costly repair or replacement of the coin chute assembly.

The present invention is directed toward an improved coin slide for use in a coin chute assembly which significantly reduces the effectiveness of using a prybar to force the coin slide outwardly to its retracted position.

SUMMARY OF THE INVENTION

The improved coin slide of the present invention provides for the inwardly facing surface of the slide handle to slope upwardly from the upper surface of the coin slide, as well as rearwardly in the direction of the outwardly facing surface of the handle, a far greater extent than that provided in the prior art coin chute assemblies. The configuration of the improved coin slide is expressed in terms of a first line defined by the intersection of a longitudinal plane perpendicular to the upper surface of the coin slide, and a second line defined by the intersection of said plane with the inwardly facing sloping surface of the slide handle. These first and second lines have a pre-determined obtuse angle to one another. In addition, the corner between the inwardly facing sloping surface of the slide handle and the upper surface of the coin slide has a pre-determined radius of curvature. The improved configuration is such that the pre-determined obtuse angle and the pre-determined radius of curvature are both sufficiently large to cause a prybar applied to the inwardly facing surface of the handle to ride up the sloping surface of the handle without being able to exert a force sufficient to move the coin slide outwardly to its retracted position against the action of the ratchet mechanism.

BRIEF DESCRIPTION OF THE DRAWINGS

For a more complete understanding of the invention and the various features and advantages thereof, reference is made to the following detailed description taken in conjunction with the accompanying drawings in which.

DESCRIPTION OF THE PREFERRED EMBODIMENT

Figure 1:
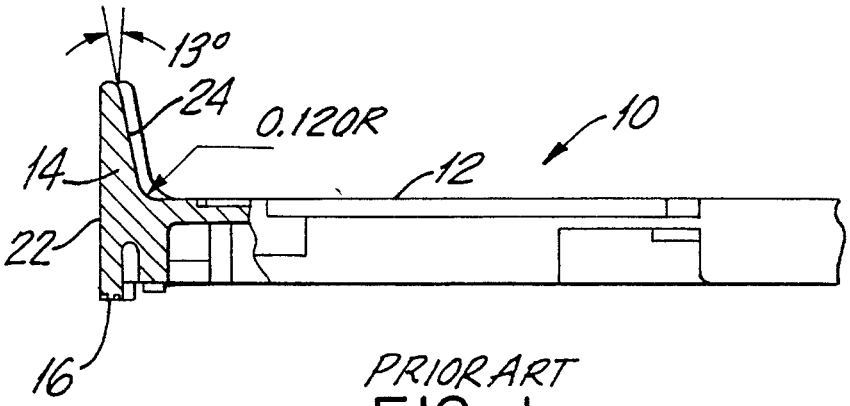
PRIOR ART FIG. 1
FIG. 1 is a partial side elevational view, with parts in section, of a coin slide representative of the prior art for use in a coin chute assembly.
Figure 2:
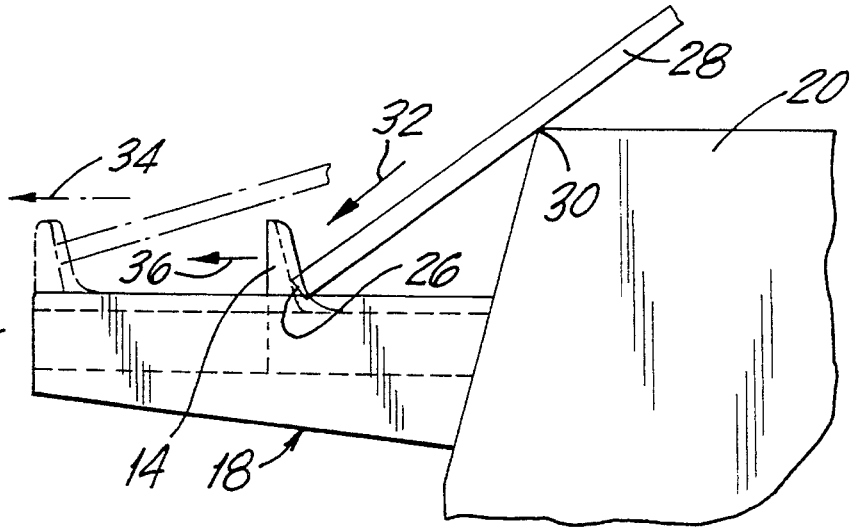
PRIOR ART FIG. 2
FIG. 2 is a partial side elevational view of the prior art coin slide of FIG. 1 assembled to a coin chute, which assembly is mounted to a housing, and showing a prybar being used to forcibly move the coin slide from a partially inserted position to its retracted position.
Figure 3:
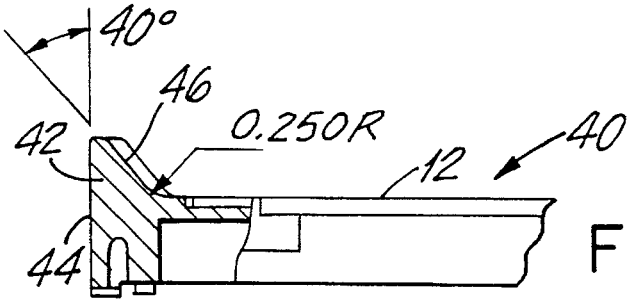
FIG. 3 is a partial side elevational view, with parts in section, of the improved coin slide embodying the present invention.

Referring to the drawings, and particularly to FIGS. 1 and 2, there is shown a coin slide 10 representative of the prior art. Slide 10 has an upper surface 12 and a finger-gripping handle portion 14 extending upwardly from surface 12. As is customary, handle 14 is positioned at the outer end 16 of the slide.

Coin slide 10 is disposed for reciprocal movement in a coin chute assembly 18 which is mounted to a housing 20. The housing, in turn, is mounted to a commercial appliance, such as a clothes washer (not shown) in a manner well known in the art. The reciprocal movement of coin slide 10 in coin chute assembly 18 is between a retracted or outward position, as shown in phantom or dot-dash line in FIG. 2, and an inserted or inward position, as shown by solid line in said figure.

Handle 14 has an outwardly facing surface 22 and an inwardly facing surface 24. While the outwardly facing surface 22 lies in a plane substantially perpendicular to the upper surface 12 of coin slide 10, the inwardly facing surface 24 of handle 14 has a slight slope upwardly and rearwardly in the direction of the outwardly facing surface 22 of the handle. The angular orientation of inwardly facing sloping surface 24 relative to the upper surface 12 of coin slide 10 is only of the magnitude of approximately 105 degrees. Also, the corner radius of curvature between the inwardly facing sloping surface 24 of handle 14 and the upper surface 12 of coin slide 10 is slight, being only in the magnitude of approximately 0.120 inches (0.305 cm).

The reference above in referring to the angular orientation of the inwardly facing sloping surface 24 of handle 14 is defined as the angle of slope of such surface. This means the angle between a line on the inwardly facing sloping surface 24 of handle 14 and a line on the upper surface 12 of coin slide 10 wherein the lines are contained in the same longitudinal plane; that is, a plane which is perpendicular to the upper surface of the slide. The term longitudinal means the direction in which the coin slide moves between its inserted and retraced positions.

As previously noted in the description of the prior art, after the coin slide 10 is moved partially inwardly a distance sufficient to actuate the appliance, slide 10 could have been moved outwardly to its retracted position with the coins still in the slide were it not for the ratchet mechanism (not shown) which permits retraction of slide 10 only after the slide has been moved to its fully inserted position to deposit the coins in a coin receptacle. In order to defeat the operation of the ratchet mechanism, an unscrupulous user would place one end 26 of prybar 28 against the inwardly facing substantially vertical surface 24 of handle 14, as shown in FIG. 2. Then, using surface 30 of housing 20 as a bearing point, prybar 28 is manipulated to exert pressure on coin slide 10 in the direction represented by arrow line 32 sufficient to move the slide outwardly in the direction represented by arrow line 34 to its retracted position (shown in phantom). In practice, increased downward pressure of prybar 28 on handle 14 with the bar maintained in contact with housing 20 serves to exert a progressively increasing horizontal component of the force, represented by arrow line 36, on the inwardly facing surface 24 of handle 14 to forcibly move coin slide 10 rearwardly against the action of the ratchet mechanism. Such forced movement of coin slide 10 permits retrieval of the coins in the slide and effectively destroys the ratchet mechanism, permitting free use of the appliance.

The improved coin slide of the present invention is shown in FIGS. 3–6 wherein those components of these figures common to the components of FIGS. 1 and 2 are depicted by the same reference numerals.

Improved coin slide 40, similar to coin slide 10, is disposed for reciprocal movement in coin chute assembly 18 which, via housing 20, is mounted to the commercial appliance. The reciprocal movement of coin slide 40 is between a retracted or outward position and an inserted or inward position.

Coin slide 40 has an upper surface 12, corresponding to that of slide 10, but an altogether different finger-gripping handle portion 42 extending upwardly from surface 12. Handle 42, similar to handle 14 of coin slide 10, has an outwardly facing surface 44 and an inwardly facing surface 46. However, unlike coin slide 10, the inwardly facing surface 46 of handle 42 slopes upwardly from surface 12 as well as rearwardly in the direction of the outwardly facing surface 44 to a far greater extent than that of handle 14 of coin slide 10.

Specifically, the configuration of coin slide 40 is expressed in terms of a first line defined by the intersection of the upper surface 12 of the coin slide 10 and a longitudinal plane perpendicular to upper surface of the slide, and a second line defined by the intersection of said plane with the inwardly facing sloping surface 46 of handle 42. These first and second lines have a pre-determined obtuse angle to one another. In the preferred embodiment, the obtuse angle is approximately 130 degrees.

Coin slide 40 also provides that the corner between the inwardly facing sloping surface 46 of handle 42 and the upper surface 12 of the slide has a pre-determined radius of curvature considerably larger than the corresponding radius of curvature applicable to coin slide 10. In the preferred embodiment, the radius of curvature is at least 0.200 inches (0.508 cm), and more in the range of approximately 0.250 inches (0.635 cm).

Figure 5:
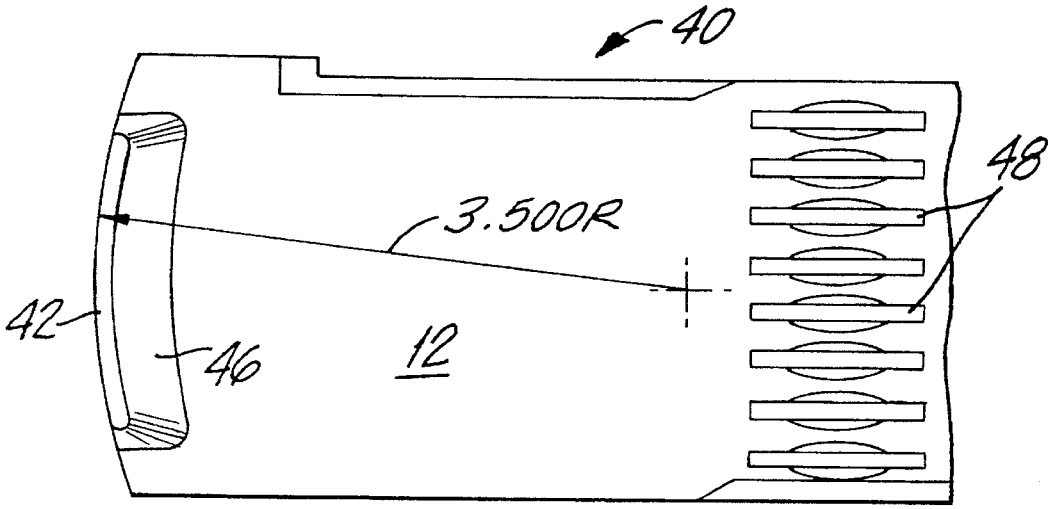
FIG. 5 is a partial plan view of the improved coin slide of FIG. 3.

The outwardly facing surface 44 of handle 42, as depicted in the top plan view of FIG. 5, has a radius of curvature of approximately 3.500 inches (8.890 cm). However, this dimension is not crucial or relevant in terms of the invention.

Figure 4:
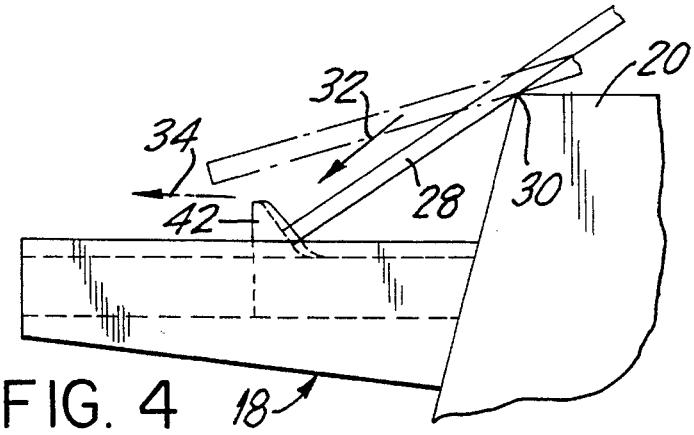
FIG. 4 is a partial side elevational view of the improved coin slide of FIG. 3 assembled to the coin chute, which assembly is mounted to the housing, and showing the prybar riding up the sloping surface of the handle portion of the coin slide so as to be ineffective to move the coin slide outwardly to its retracted position.
Figure 6:
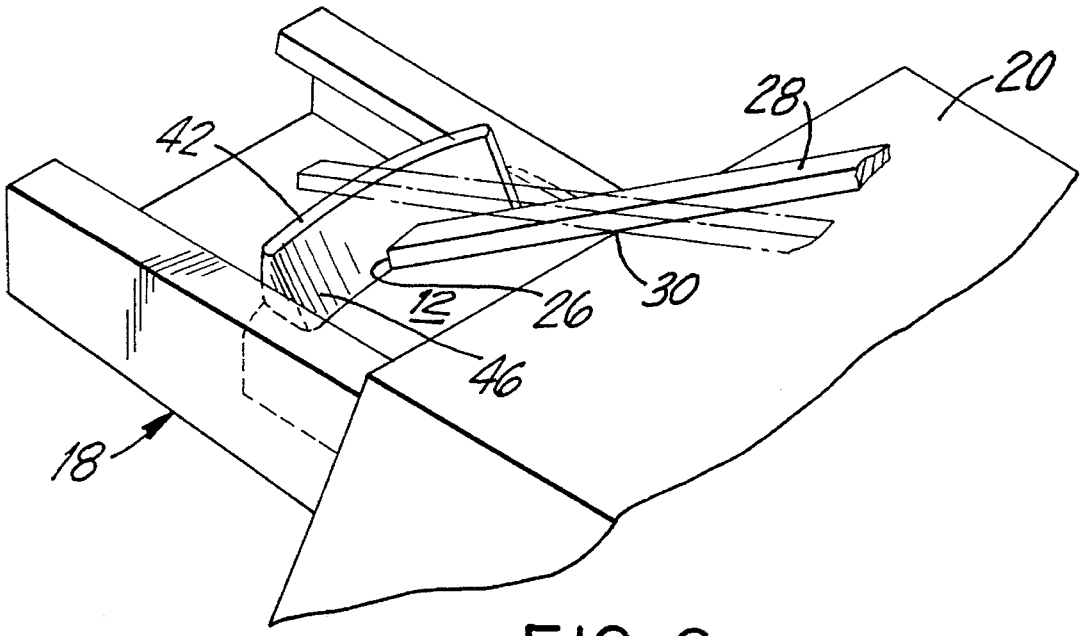
FIG. 6 is a perspective view of the assembly shown in FIG. 4 again showing the ineffectiveness of the prybar in trying to move the coin slide outwardly to its retracted position.

As will now become evident, when an unscrupulous user places the prybar 28 against the inwardly facing inclined surface 46 of handle 42 after the coin slide 40 has been moved partially inwardly a distance sufficient to actuate the appliance, as shown in FIGS. 4 and 6, increased downward pressure of the bar will no longer have the tendency to move coin slide 40 rearwardly to its retracted position against the action of the ratchet mechanism. Instead, the obtuse angle and the radius of curvature heretofore alluded to in connection with coin slide 40 are each sufficiently large to cause the end 26 of prybar 28, which is forcibly applied to the inwardly facing surface 46 of handle 42, to ride up such inclined surface and off the handle. That is, the horizontal component of force generated by manipulation of prybar 28 on handle 42 is insufficient or ineffective to move coin slide 40 rearwardly against the action of the ratchet mechanism.

As such, the integrity of the ratchet mechanism will be preserved to prevent rearward movement of coin slide 40 back to its retracted position, at this stage of the operation of the coin chute assembly, and prevent retrieval of the coins that are carried in the coin receiving slots 48 of the slide. As will be further evident, the inwardly facing surface 46 of handle 42 preferably has a smooth metal finish to accommodate the sliding of prybar 28 off of surface 46 as pressure is applied by the bar.

While a preferred embodiment of the invention has been shown and described in detail, it will be apparent to those skilled in the art that various changes and modifications may be made without departing from the basic principles of the invention as embraced by the following claims.

What is claimed is:

1. In a coin chute assembly having a coin slide disposed for reciprocal movement between a retracted position and an inserted position, said coin slide having an upper surface and a finger-gripping portion extending upwardly from said upper surface, said finger-gripping portion functioning as a handle for said coin slide to permit a user to reciprocally move said slide between its retracted and inserted positions, and said handle having an outwardly facing surface and an inwardly facing surface, wherein the improvement comprises:

the inwardly facing surface of said coin slide handle having a slope that extends upwardly from the upper surface of said coin slide as well as rearwardly in the direction of the outwardly facing surface of said handle;

the thickness of said coin slide handle between its outwardly and inwardly facing surfaces at the corner where the inwardly facing surface of said handle meets with the upper surface of said coin slide being substantially greater than the thickness of said coin slide;

a first line defined by the intersection of the upper surface of said coin slide and a longitudinal plane perpendicular to the upper surface of said coin slide and a second line defined by the intersection of said plane with the inwardly facing sloping surface of said coin slide handle, said first and second lines having a pre-determined obtuse angle to one another; and the corner between the inwardly facing sloping surface of said coin slide handle and the upper surface of said coin slide having a pre-determined radius of curvature;

said obtuse angle being sufficiently large and said radius of curvature being sufficiently large to cause a prybar forcibly applied to the inwardly facing surface of said coin slide handle to ride up the sloping surface of said handle.

2. The coin chute assembly of claim 1, wherein said obtuse angle is approximately 130 degrees.

3. The coin chute assembly of claim 1, wherein said radius of curvature is approximately 0.250 inches (0.635 cm).

4. The coin chute assembly of claim 2, wherein said radius of curvature is approximately 0.250 inches (0.635 cm).

5. The coin chute assembly of claim 1, wherein said radius of curvature is at least 0.200 inches (0.508 cm).

6. The coin chute assembly of claim 2, wherein said radius of curvature is at least 0.200 inches (0.508 cm).

7. The coin chute assembly of claim 1, wherein the outwardly facing surface of said coin slide handle extends vertically upwardly from the upper surface of said coin slide and substantially perpendicular to said upper surface of said slide.

8. In a coin chute assembly having a coin slide disposed for reciprocal movement between a retracted position and an inserted position, said coin slide having an upper surface and a finger-gripping portion extending upwardly from said upper surface, said finger-gripping portion functioning as a handle for said coin slide to permit a user to reciprocally move said slide between its retracted and inserted positions, and said handle having an outwardly facing surface and an inwardly facing surface, wherein the improvement comprises:

the inwardly facing surface of said coin slide handle having a slope that extends upwardly from the upper surface of said coin slide as well as rearwardly in the direction of the outwardly facing surface of said handle;

the outwardly facing surface of said coin slide handle extending vertically upwardly from the upper surface of said coin slide and substantially perpendicular to said upper surface of said slide;

a first line defined by the intersection of the upper surface of said coin slide and a longitudinal plane perpendicular to the upper surface of said coin slide and a second line defined by the intersection of said plane with the inwardly facing sloping surface of said coin slide handle, said first and second lines having an obtuse angle of approximately 130° to one another; and the corner between the inwardly facing sloping surface of said coin slide handle and the upper surface of said coin slide having a radius of curvature of approximately 0.250 inches (0.635 cm);

said obtuse angle and said radius of curvature being such to cause a prybar forcibly applied to the inwardly facing surface of said coin slide handle to ride up the sloping surface of said handle.

* * * * *